US010125615B2

(12) United States Patent
Congratel et al.

(10) Patent No.: US 10,125,615 B2
(45) Date of Patent: Nov. 13, 2018

(54) TURBINE WHEEL FOR A TURBINE ENGINE

(71) Applicant: SNECMA, Paris (FR)

(72) Inventors: Sébastien Serge Francis Congratel, Moissy Cramayel (FR); Franck Boisnault, Moissy Cramayel (FR); Patrice Jean-Marc Rosset, Moissy Cramayel (FR)

(73) Assignee: SNECMA, Paris (FR)

( * ) Notice: Subject to any disclaimer, the term of this patent is extended or adjusted under 35 U.S.C. 154(b) by 328 days.

(21) Appl. No.: 14/931,443

(22) Filed: Nov. 3, 2015

(65) Prior Publication Data

US 2016/0123157 A1 May 5, 2016

(30) Foreign Application Priority Data

Nov. 4, 2014 (FR) ..... 14 60648

(51) Int. Cl.

| | |
|---|---|
| ***F01D 5/22*** | (2006.01) |
| ***F01D 5/30*** | (2006.01) |
| ***F01D 11/00*** | (2006.01) |

(52) U.S. Cl.

CPC ..... *F01D 5/225* (2013.01); *F01D 5/22* (2013.01); *F01D 5/3007* (2013.01); *F01D 11/006* (2013.01); *F05D 2240/80* (2013.01); *F05D 2260/30* (2013.01); *F05D 2260/96* (2013.01)

(58) Field of Classification Search

CPC ... F01D 5/10; F01D 5/22; F01D 5/225; F01D 5/3007; F01D 11/006; F01D 11/008; F01D 25/04; F01D 25/06; F05D 2260/96

See application file for complete search history.

(56) References Cited

U.S. PATENT DOCUMENTS

| | | | | |
|---|---|---|---|---|
| 5,228,835 A | | 7/1993 | Chlus | |
| 5,803,710 A | * | 9/1998 | Dietrich | F01D 5/22 416/248 |
| 5,924,699 A | * | 7/1999 | Airey | F01D 11/008 277/411 |
| 7,214,034 B2 | * | 5/2007 | Giot | F01D 5/22 416/193 A |
| 2014/0119918 A1 | | 5/2014 | Tarczy et al. | |

FOREIGN PATENT DOCUMENTS

| | | |
|---|---|---|
| FR | 2 963 382 A1 | 2/2012 |
| FR | 2 972 759 A1 | 9/2012 |
| FR | 2 981 979 A1 | 5/2013 |
| GB | 2 116 641 A | 9/1983 |

* cited by examiner

*Primary Examiner* — Justin Seabe
*Assistant Examiner* — Brian P Wolcott
(74) *Attorney, Agent, or Firm* — Blank Rome LLP

(57) ABSTRACT

A turbine wheel for a turbine engine comprising a disc carrying blades. Each blade comprises an upstream radial wall and a downstream radial wall which extend inwards from the platform of the blade. Inter-blade cavities each accommodate one inter-blade sealing and vibration damping member. According to the invention, each inter-blade sealing and vibration damping member comprises at least a first transverse partition wall axially arranged at a distance from a downstream (or upstream, respectively) portion of the member and axially opposite two upstream (or downstream, respectively) so as to obstruct a flow of incoming air into the cavity between two adjacent upstream radial walls or two adjacent downstream radial walls.

9 Claims, 2 Drawing Sheets

Fig. 4
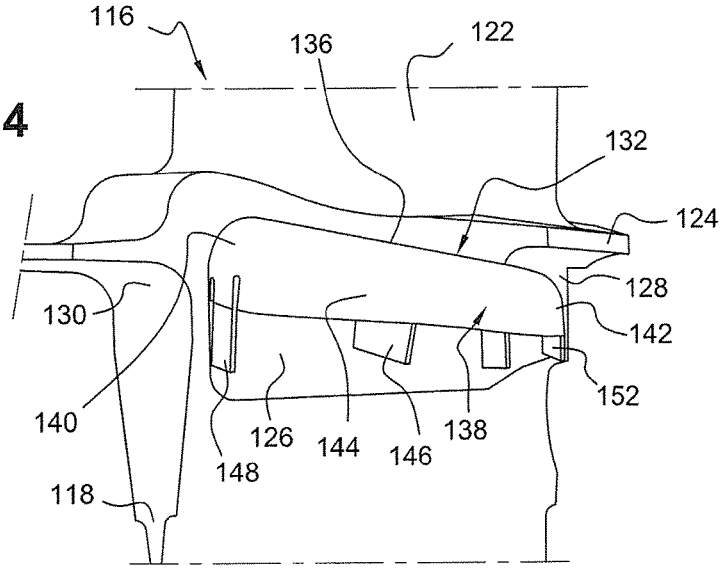
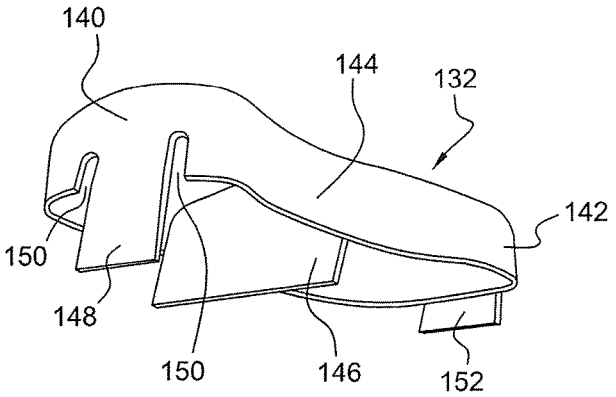
Fig. 5
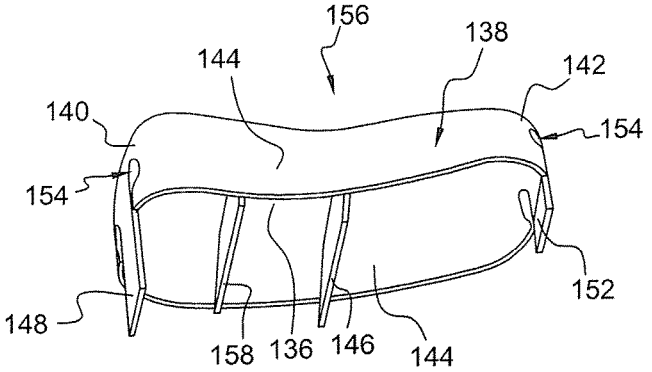
Fig. 6

TURBINE WHEEL FOR A TURBINE ENGINE

BACKGROUND OF THE INVENTION

1. Field of the Invention

The present invention relates to a turbine wheel for a turbine engine, such as an aircraft jet engine or turboprop provided with such a wheel. It also relates to a sealing and vibration damping member intended to be used with a turbine wheel and a turbine engine, as mentioned above.

2. Description of the Related Art

A wheel 10 of a high pressure turbine in a turbine engine, as shown in FIG. 1, comprises a disc 14 carrying blades 16 regularly distributed around the wheel axis and the roots 18 of which are engaged into substantially axial notches of the periphery of the disc 14. The blade roots 18 may be of the fir tree or dovetail section type, and the grooves in the disc 14 have shapes that match those of the blade roots 18 and define teeth or ribs 20 between them.

Each blade 16 comprises an impeller 22 connected to its radially inner end to a platform 24, which is itself connected to a root 18 by a stilt 26.

The upstream end and the downstream end of each platform 24 are respectively connected to an upstream radial wall 30 extending radially inwards and to a downstream radial wall 28 extending radially inwards.

In mounting position (FIGS. 1 and 2), the platforms 24 of the blades 16 are circumferentially arranged end-to-end so as to form an inner annular wall for the flowing of primary air from a combustion chamber. Similarly, the upstream 30 and downstream 28 radial walls are arranged opposite each other on the circumference.

Mounting sealing and vibration damping members 32 into inter-blade cavities is known. More particularly, each inter-blade cavity is defined radially outwards by the inner faces of two platforms 24 positioned opposite each other on the periphery, radially inwards by a rib 20 of the disc 14, axially by two transverse upstream 30 and downstream 28 radial walls, the ends of which are positioned opposite each other on the periphery, and circumferentially by the stilts 26 of the blades 16.

As shown in FIG. 2, the inner faces of two adjacent platforms 24 define together a truncated surface portion. Such truncated surface portion has a section perpendicular to the spindle of the wheel tapering downwards.

In operation, it is particularly important to ensure the inter-blade sealing between two adjacent downstream radial walls 28 as well as the inter-platform 24 sealing.

However, in operation, the sealing and vibration damping members 32 are each moved upstream because of the truncated shape of the blades 16 of the platforms 24 and the centrifuge force which results in that the sealing members 32 and the downstream radial walls 28 are no longer in contact. Similarly, air can circulate between the downstream ends of the platforms 24. Such loss of sealing induces a recirculation of hot air inside the platforms 24 towards the ribs 20 of the disc 14 which may be damaged.

If the problem of the sealing members 32 moving appears in the case mentioned above, it should be noted that the same difficulty may arise in the case of a truncated jet having an upstream tapering section, and when sealing is desired upstream. Similarly and more generally, defective sealing can be noted in the case of a cylindrical jet because of manufacturing tolerances and defective positioning of said members 32.

SUMMARY OF THE INVENTION

The invention more particularly aims at providing a simple, efficient and cost-effective solution to the problems of the prior art described above.

For this purpose, it provides for a turbine wheel for a turbine engine, comprising a disk carrying blades each having a platform, carrying an impeller connected by a stilt to a root, with each blade comprising an upstream radial wall and a downstream radial wall extending inwards from the platform of the blade, with the roots of the blades being engaged into notches on the periphery of the disk, so that the radial walls of the blades and the platforms of the blades are circumferentially arranged end-to-end, and define inter-blade cavities radially inside the platforms each accommodating an inter-blade sealing and vibration damping member comprising a bottom wall intended to apply onto the inner faces of two adjacent platforms and extending inwards on its periphery by a flanged edge a downstream, or an upstream portion of which is intended to apply onto two adjacent downstream or upstream, respectively, radial walls, characterized in that each member comprises at least a transverse partition wall arranged axially at a distance from said downstream or upstream, respectively, portion of the member and axially opposite two adjacent upstream or downstream respectively radial walls so as to obstruct the flowing of incoming air into the cavity between the two upstream or downstream, respectively, radial walls.

The invention also provides adding a partition wall transverse relative to the sealing and vibration damping members so that air which circulates in the gap between two upstream or downstream, respectively radial walls impacts the partition wall, which results in the member moving downstream or upstream, respectively and ensures a contact between the member and the downstream or upstream, respectively inter-blade radial walls.

According to another characteristic of the invention, the inner faces of the platforms define a truncated surface with a section perpendicular to the axis of the wheel tapering downstream, or upstream, respectively.

Applying air flow onto the partition wall thus makes it possible to control the upstream or downstream, respectively motion of the member, so that inter-blade sealing can be ensured between the downstream, or upstream, respectively and the downstream ends of the blade platforms.

According to still another characteristic of the invention, said partition wall of each member radially protrudes inwards with respect to the flanged edge. The stress applied to the partition wall is thus more important for the same air flow, relative to a partition wall which does not extend radially inwards with respect to the flanged edge.

The flanged edge is preferably formed with two side flanks each axially extending along the faces of two adjacent stilts, with said partition wall extending from one flank to another.

Said partition wall is advantageously arranged axially, substantially in the middle of the platforms.

According to another characteristic of the invention, each member comprises an upstream or downstream, respectively portion which comprises at least one opening for the passage of air.

Said upstream or downstream, respectively portion may also comprise two notches opening inwards, arranged on either side of a lug.

According to another characteristic of the invention, at least one of the members comprises a first partition wall mentioned above and a second transverse partition wall axially arranged between two adjacent upstream, or downstream, respectively radial walls and the first partition wall.

The invention also relates to a turbine engine, such as a turbojet or a turboprop, characterized in that it comprises a turbine comprising at least one turbine wheel as described above.

The invention also relates to a sealing and vibration damping member, more particularly for a turbine wheel of the type described above, comprising a bottom wall extending in a peripheral flanged edge, having two opposite flanks and two end portions, one of which comprises two notches opening on the side opposite the bottom wall.

BRIEF DESCRIPTION OF THE DRAWINGS

The invention will be better understood, and other details, characteristics and advantages of the invention will appear upon reading the following description given by way of a non-restrictive example while referring to the appended drawings wherein:

FIG. 4 is a partial schematic upstream view, in perspective, of a turbine wheel according to the invention;

FIG. 5 is a separated schematic view, in perspective, of an inter-blade sealing and vibration damping member according to the invention.

FIG. 6 is a separated schematic view in perspective of another embodiment of an inter-blade sealing and vibration damping member according to the invention.

DETAILED DESCRIPTION OF THE PREFERRED EMBODIMENTS

Figure 1:
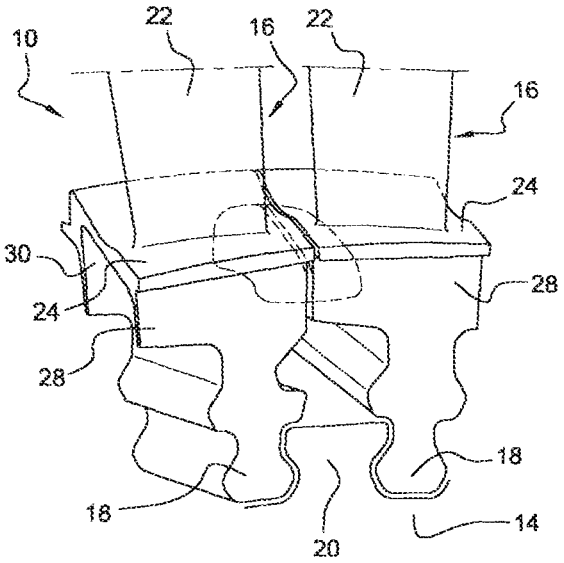
Fig. 1 (PRIOR ART)
FIG. 1 is a partial schematic view, in perspective, of a turbine wheel according to the known technique.

As FIG. 1 has already been described above, reference is now made to FIG. 2 which shows a sealing member 32 according to the known technique, intended to be mounted into an inter-blade cavity.

More specifically, each member 32 comprises a bottom wall 36 which extends on the whole periphery thereof into a flanged edge 38 or peripheral edge, which extends substantially radially inwards. The flanged edge 38 of each member 32 comprises an upstream portion 40 and a downstream portion 42, as well as two side flanks 44 which connect the upstream 40 and downstream 42 portions. Each sealing and vibration damping member 32 has an external shape matching that of the faces of the walls which define and inter-blade cavity, so that the sealing member 32 can come into contact with such faces and provide sealing at the junction between the platforms 24 and the upstream 30 and downstream 28 radial walls.

Figure 2:
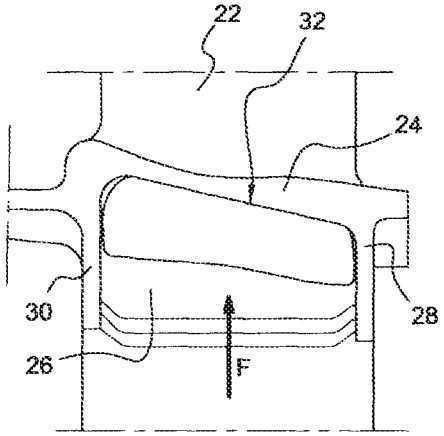
Fig. 2 (PRIOR ART)
FIG. 2 is a partial and side schematic view, in perspective, of a blade of a turbine wheel accommodating a sealing and vibration damping member.
Figure 3:
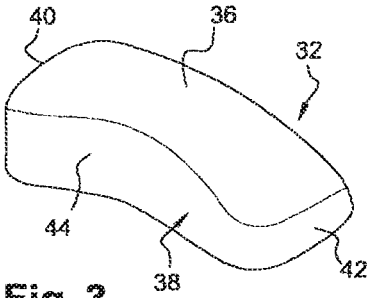
(PRIOR ART) Fig. 3
FIG. 3 is a schematic view in perspective of a sealing and vibration damping member according to the prior art.

As can be seen in FIG. 2, in operation, the sealing member 32 is moved upstream by the centrifuge force and the truncated shape of the inner faces of the platforms 24 having a downstream tapering section. The result is that the members 32 are no longer in contact with the downstream radial walls 28 and the downstream ends of the platforms 24.

In the following description relating to the invention, the parts which are similar to those described above have a reference with a number increased by a hundred.

According to the invention, a turbine wheel for a turbine engine comprises a disk carrying blades 116. Each blade 116 comprises a platform 124, wherein the platform 124 carries an impeller 122 connected by a stilt 126 to a root 118. Inter-blade sealing and vibration damping members 132 each comprise a first transverse partition wall 146 which extends radially inwards from the bottom wall 136 and substantially from a flank 144 up to an opposite flank 144. "Transverse" means here a partition wall which extends on the circumference and radially outwards. Each first transverse partition wall 146 protrudes inwards with respect to the radially inner end of the flanged edge 138 or peripheral edge. Each first transverse partition wall 146 has a substantially rectangular flat shape and is inclined by an angle $\alpha$ ranging from $-45°$ to $45°$ relative to a radial plane.

The upstream portion 140 of each inter-blade sealing and vibration damping member 146 comprises a lug 148 which extends radially inwards as a protrusion relative to the rest of the upstream portion 140. The upstream portion 140 of the flanged edge 138 also comprises a notch 150 radially opening inwards on either side of the lug 148.

In operation, air can circulate in the gap between two upstream radial walls 130 and in the notches 150 of the upstream portion of the inter-blade sealing and vibration damping member 132 and then impacts the first transverse partition wall 146, which makes it possible to avoid moving the inter-blade sealing and vibration damping member 132 upstream.

In practice, it should be noted that the notches 150 must have dimensions enabling the passage of a sufficient air flow which makes it possible to keep the downstream portion 142 of the inter-blade sealing and vibration damping member resting on the downstream radial walls 128, according to the inclination of the first transverse partition wall 146, and thus to provide a perfect inter-blade sealing. The notches 150 extend substantially radially.

As shown in FIG. 5, a lug 152 radially extends inwards from the downstream portion 142, but has no notch on either side of the lug 152, like the downstream portion.

In another alternative embodiment of the inter-blade sealing and vibration damping member 156 shown in FIG. 6, the downstream portion 142 of the flanged edge 138 also comprises two notches 154 radially opening inwards on either side of the lug 152. The upstream and downstream notches 154 each comprise a portion with a reduced section opening in a portion with a larger section and a substantially circular rounded shape. Such rounded shape gives the lugs 148, 152 a greater flexibility. The lugs 148, 152 are advantageously elastically deformable and may be elastically prestressed against the upstream 130 and downstream 128 radial walls so as to provide a radial holding of the inter-blade sealing and vibration damping member 132 in the cavity.

Additionally, in this embodiment, the inter-blade sealing and vibration damping member 156 comprises a second transverse partition wall 158 which extends between the two side flanks 144 and axially arranged between the first transverse partition wall 146 and the upstream portion 140 of the flanged edge 138. The radial dimension of the first transverse partition wall 146 is greater than the radial dimension of the second transverse partition wall 158 so that air first impacts the second transverse partition wall 158 then the first transverse partition wall 146.

In the embodiments shown in FIGS. 4 to 6, the first partition wall 146 is formed axially, substantially in the middle of the inter-blade sealing and vibration damping member 132, 156 and substantially in the middle of the platforms 124.

The invention claimed is:

1. A turbine wheel for a turbine engine, comprising:

a disk carrying blades, each blade comprising:

a platform, wherein the platform carries an impeller and the platform is connected by a stilt to a root;

an upstream radial wall; and a downstream radial wall;

wherein the upstream radial wall and the downstream radial wall extend inwards from the platform, with the root of each blade being engaged into notches on a periphery of the disk, so that the upstream radial wall, the downstream radial wall, and the platform are circumferentially arranged end-to-end, and define an inter-blade cavity radially inside each platform, each inter-blade cavity accommodating an inter-blade sealing and vibration damping member comprising:

a bottom wall applying onto inner faces of two adjacent platforms and extending inwards on its periphery by a flanged edge, the flanged edge having a downstream portion applying onto a downstream radial wall and an upstream portion applying onto an upstream radial wall; and at least a first transverse partition wall arranged axially at a distance from said downstream portion of the inter-blade sealing and vibration damping member and from said upstream portion of the inter-blade sealing and vibration damping member so as to obstruct a flowing of incoming air into the inter-blade cavity between two adjacent upstream radial walls or two adjacent downstream radial walls, wherein the flanged edge has a first side flank and a second side flank, each axially extending along faces of two adjacent stilts, with said first transverse partition wall extending from the first side flank to the second side flank.

2. The turbine wheel according to claim 1, wherein the inner faces of the adjacent platforms define a truncated surface with a section perpendicular to an axis of the turbine wheel, the truncated surface tapering downstream, or upstream, respectively.

3. The turbine wheel according to claim 1, wherein said first transverse partition wall of each member radially extends inwards relative to the flanged edge.

4. The turbine wheel according to claim 1, wherein said first transverse partition wall is axially arranged substantially in a middle of the adjacent platforms.

5. The turbine wheel according to claim 1, wherein each inter-blade sealing and vibration damping member comprises at least one opening for a passage of air in at least one of the upstream portion of the inter-blade sealing and vibration damping member and the downstream portion of the inter-blade sealing and vibration damping member.

6. The turbine wheel according to claim 5, wherein at least one of the upstream portion of the inter-blade sealing and vibration damping member and the downstream portion of the inter-blade sealing and vibration damping member comprises two notches opening inwards, arranged on each side of a lug.

7. The turbine wheel according to claim 1, wherein at least one inter-blade sealing and vibration damping member further comprises a second transverse partition wall axially arranged between the first transverse partition wall and one of the upstream radial wall and the downstream radial wall.

8. A turbine engine comprising a turbine having at least one turbine wheel according to claim 1.

9. The inter-blade sealing and vibration damping member for a turbine wheel according to claim 1, comprising a bottom wall extending inwards on its periphery by a flanged edge, the flanged edge comprising a first side flank and a second side flank between which a first transverse partition wall extends.

* * * * *